US005161389A

United States Patent [19]

Rockenfeller et al.

[11] Patent Number: 5,161,389

[45] Date of Patent: Nov. 10, 1992

[54] APPLIANCE FOR RAPID SORPTION COOLING AND FREEZING

[75] Inventors: Uwe Rockenfeller; Lance D. Kirol, both of Boulder City, Nev.

[73] Assignee: Rocky Research, Boulder City, Nev.

[21] Appl. No.: 612,412

[22] Filed: Nov. 13, 1990

[51] Int. Cl.[5] ..... F25B 17/08

[52] U.S. Cl. ..... 62/480; 62/106

[58] Field of Search ..... 62/476, 478, 479, 480, 62/107, 112, 106, 4

[56] References Cited

U.S. PATENT DOCUMENTS

| | | | |
|---|---|---|---|
| 1,833,901 | 1/1931 | Hull | 62/480 |
| 2,557,373 | 6/1951 | Coons | 62/480 |
| 4,199,959 | 4/1980 | Wurm | 62/480 |
| 4,548,046 | 10/1985 | Brandon et al. | 62/480 |
| 4,694,659 | 9/1987 | Shelton | 62/106 |
| 4,709,558 | 12/1987 | Matsushita et al. | 62/106 |
| 4,759,191 | 7/1988 | Thomas et al. | 62/101 |
| 4,765,395 | 8/1988 | Paeye et al. | 62/480 |
| 4,822,391 | 4/1989 | Rockenfeller | 62/112 |
| 4,848,994 | 7/1989 | Rockenfeller | 62/112 |
| 4,881,376 | 11/1989 | Yonezawa et al. | 62/480 |
| 4,901,535 | 2/1990 | Sabin et al. | 62/101 |
| 4,956,977 | 9/1990 | Laxhuber et al. | 62/106 |
| 4,958,055 | 9/1990 | Shim | 219/10.55 B |
| 5,024,064 | 6/1991 | Yonezawa et al. | 62/106 |

*Primary Examiner*—Albert J. Makay
*Assistant Examiner*—J. Sollecito
*Attorney, Agent, or Firm*—Jerry R. Seiler

[57] ABSTRACT

An apparatus capable of rapidly cooling or freezing a composition comprising a walled housing member having a cooling chamber and a door for accessing the cooling chamber from the exterior of the housing, an evaporator and a blower for circulating cold air from the evaporator to the cooling chamber, first and second reactors each containing a complex compound consisting of a metal salt and ammonia adsorbed thereon, heaters in the reactors for heating the complex compound, and valves and conduits for directing ammonia from the evaporator to the reactors, from the reactors to the condenser, and from the condenser to the evaporator, and control means for sequentially operating the heaters for alternately heating the complex compounds in the reactors, operating the air handling means and one or more of the valves, and switching means for turning the apparatus on and off. The apparatus may be of a size suitable for a household appliance, and includes an embodiment combining the components with a microwave oven for selectively providing rapid cooling and microwave heating.

28 Claims, 3 Drawing Sheets

APPLIANCE FOR RAPID SORPTION COOLING AND FREEZING

BACKGROUND OF THE INVENTION

The usefulness of a household appliance for rapidly cooling or quick-freezing foods and liquids is readily apparent. Presently used mechanical refrigeration technology does not lend itself readily to a household appliance, for example, the size of presently existing household microwave ovens, mainly due to the size requirements of mechanical compressors using freon based systems having sufficiently low temperature capabilities. Other heat pump systems using adsorbents such as zeolites, metalhydrydes or activated carbon material with gaseous reactants are also impractical because of poor refrigerant holding capacities, low power density, etc. and would result in a much larger apparatus having substantially higher manufacturing costs in comparison to those of the present invention. Gaseous reactants such as hydrogen also require high recharge temperatures and pose potential safety risks, unsuitable for household appliances. Other heat pump systems using adsorption and desorption cycle techniques require internal heating and cooling of the reactor bed with liquid heat exchange capabilities, also quite impractical for relatively low cost, household appliance size equipment having suitable low temperature capabilities.

SUMMARY OF THE INVENTION

The present invention is directed to an apparatus capable of providing intense low temperature convective cooling for relatively short time periods of up to approximately 20 minutes. The apparatus has few moving parts, other than fans for cooling the components with room temperature air, minimizes maintenance requirements and manufacturing costs, has relatively noise free operation, and is of a compact design ideally suitable for a household appliance, although the technology may be also used for commercial purposes, such as restaurants, commercial kitchens, and the like. A specific embodiment of an apparatus of the invention comprises a walled housing member having a cooling chamber and a door for accessing the cooling chamber from the exterior of the housing member, a condenser for converting gaseous refrigerant to a liquid phase, and means for cooling the condenser with ambient air, a plurality of reactors, each containing a complex compound of ammonia and a chloride, bromide, sulphate or chlorate salt of a metal selected from the group consisting of an alkali and alkaline earth metal, chromium, manganese, iron, cobalt, nickel, cadmium, tantalum and rhenium, a heater in each reactor, for heating the complex compound therein, valve means cooperating with conduit means for alternately directing ammonia from the evaporator to first and second reactors, respectively, valve means cooperating with conduit means for alternatively directing ammonia from first and second reactors, respectively, to the condenser, valve means cooperating with conduit means for alternatively directing ammonia from the condenser to the evaporator, control means for sequentially operating said heaters for alternatively heating said complex compounds in the first and second reactors, for operating the air handling means, and for operating one or more valve means, and switching means for being connected to a source of electrical power for turning the apparatus on and for energizing the control means The apparatus of the invention is capable of providing intense low temperature convection cooling, −10° F. to −70° F., for relatively short periods of time of up to about 20 minutes, suitable for chilling beverages, desserts or other foods to be served cold, and for rapidly freezing compositions to prepare ice cream, POPSICLES ®, freezing left-overs, and the like. Such an apparatus is also useful in chilling or freezing medical or laboratory compositions where quick-freeze requirements are desired in a relatively small portable appliance.

DETAILED DESCRIPTION OF THE PREFERRED EMBODIMENT

Figure 1:
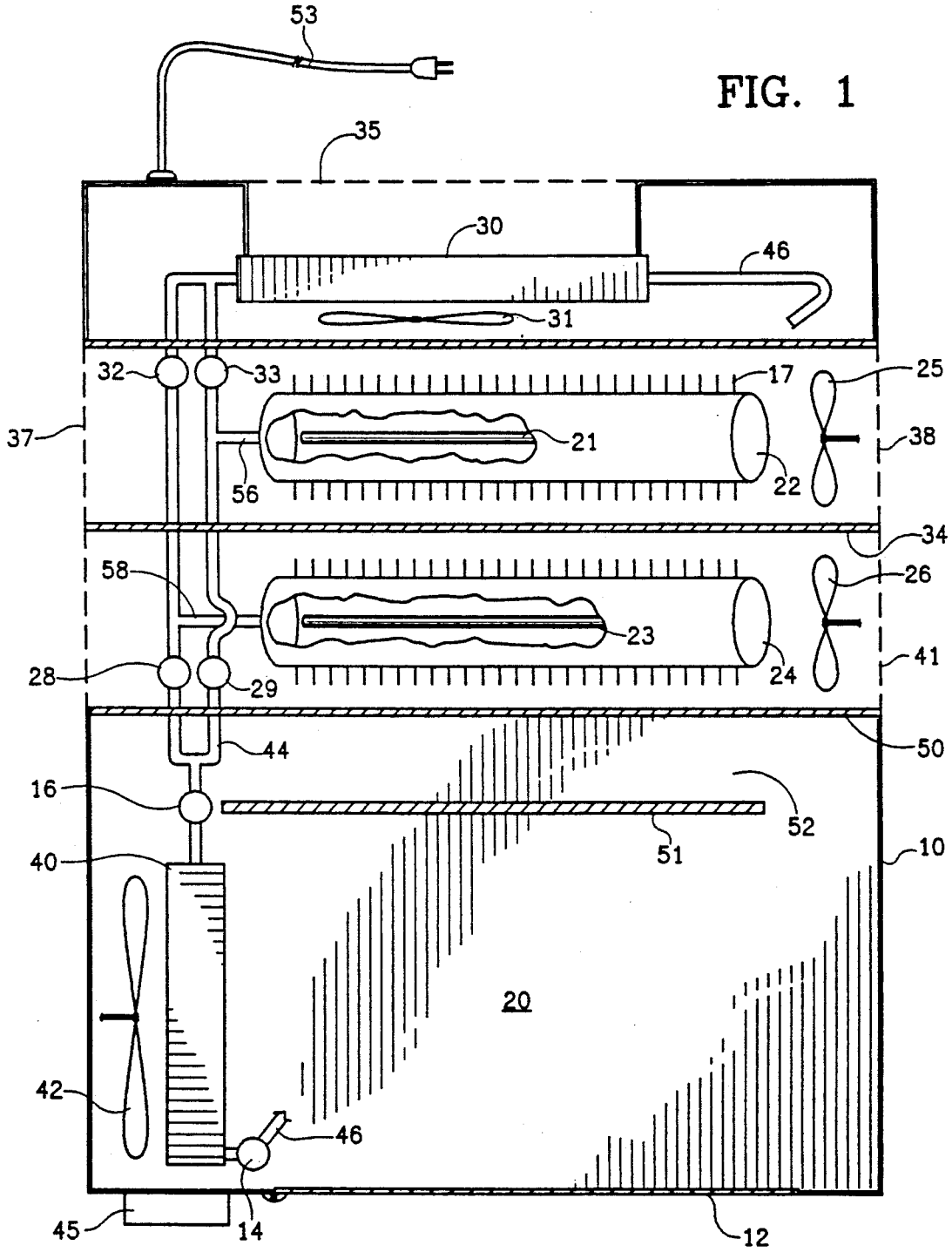
FIG. 1 is a schematic illustration of the apparatus of the invention showing the various components.
Figure 2:
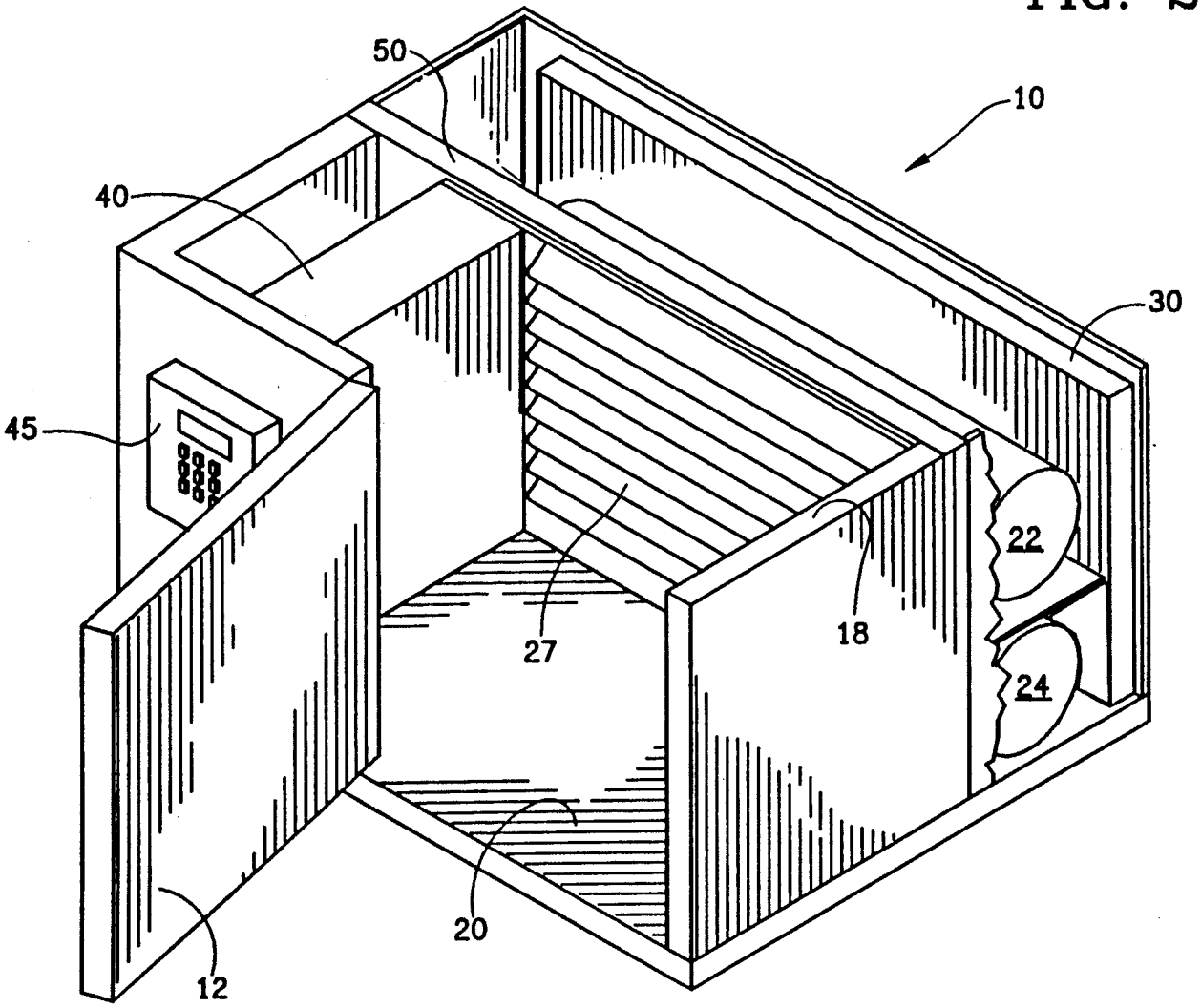
FIG. 2 is an illustration of the interior of a housing for an appliance size apparatus of the invention with the top removed and a portion of a side cut-away to illustrate location and relative size of typical interior compartments for various components.

As shown in FIG. 1, the apparatus of the invention comprises a housing member 10 in which the various components of the appliance, including a cooling chamber 20, are located. The basic components of the apparatus include an evaporator 40, preferably located adjacent to and in thermal contact or exposure with the cooling chamber 20. The evaporator 40, in which liquid ammonia is evaporated to provide the cooling effect of the apparatus, also cooperates with air handling means such as a blower or fan 42 which circulates the air across or over the evaporator and into the cooling chamber. Cooling chamber 20 is also thermally isolated from the other compartments and components of the apparatus to maximize its cooling efficiency and so that during operation warm or heated air from other components and compartments will not interfere with the cold air circulated to and from the cooling chamber. A design similar to that illustrated in FIG. 1, suitable for a household appliance size apparatus, is shown generally in FIG. 2, incorporating an insulated wall 50 thermally isolating the cooling chamber 20 from the other compartments in the apparatus. A divider 51 creating a passageway 52 for cold air return from the cooling chamber 20 to the fan 42, may be provided. Alternative means for achieving such circulation is shown in FIG. 2, including a louvered wall 27 for an equivalent circulation. Other equivalent components to create suitable air circulation from the evaporator to the cooling chamber and return to the fan may be incorporated.

The apparatus includes a pair of reactors 22 and 24, preferably in separate compartments as shown, each having separate fans 25 and 26, respectively, for cooling the reactors. Cooperating with the fans for each of the reactor compartments are vents 37 and 38, and 39 and 41, respectively, for introducing relatively cool room air into the reactor compartments and venting the air heated by exposure to heat exchange fins 17 to the apparatus. Each reactor is also provided with a resistance heating element 21 and 23, respectively, electrically connected to a power source for alternately heating a complex compound in the reactor as will be more fully explained. The reactors are shown partially broken away in FIG. 1 to schematically illustrate such a feature. Although other means for heating and cooling the reactors may be used, for example gas heaters with hot air or heat exchange tubes exposed to the complex compounds in the reactors, for a relatively small household appliance size apparatus, resistance heaters for heating the complex compounds with fans for air cooling the reactors are especially preferred.

A condenser 30 is also provided, and a fan 31 for drawing room air into the condenser compartment to provide necessary cooling of the condenser for condensation of the ammonia. The condenser is provided with suitable heat exchange fins cooperating with coiled conduits, or other equivalent means for cooling the ammonia during condensation, as will be understood by those skilled in the art. A vent grill 35 is provided on the housing exterior for assisting the air circulation, or the condenser coil may be located on the exterior of the appliance if desired. However, due to the relatively small size of the apparatus, to improve efficiency, it may be preferred to utilize a forced air means for directing the cooler ambient air over the condenser. Again, as illustrated in FIG. 1, it may be preferable to locate each of the respective reactors 22, 24, and condenser 30 in separate compartments, at least somewhat thermally isolated from one another, so that during the cooling of each of the respective components, the other adjacent component will not interfere with cooling efficiency.

A conduit system and valves cooperate to provide direction of ammonia between the condenser, reactors, and evaporator are illustrated and will be pointed out specifically during the following discussion of operation of the appliance. The important function of the valves cooperating with the conduits is to ensure that ammonia will be alternately directed from the evaporator to one reactor at a time during adsorption of the ammonia in the metal salt or complex compound contained in the adsorbing reactor, and to direct the ammonia from a desorbing reactor to the condenser.

Valve 16, as well as the various fans used for circulating air to the cooling chamber and for cooling the reactors and condenser, are operated by electrical power and operationally controlled by a controller 45 which includes various switches for sequentially operating the heaters, fans, and for turning the appliance on and off. The details of the circuitry for such operation, switching and actuation of the appliance will be known to those skilled in the art, and thus are not described here in further detail. An electric cord and plug 53 are also illustrated schematically in FIG. 1 for being connected to a source of electrical power for operating the apparatus in response to the functions programmed in the controller. For this purpose, the controller may also be provided with a microcomputer, including memory means and timing means, similar to that of a microwave oven controller, for operating the appliance for a selected period of time, and turning it off. Such a controller may also cooperate with temperature sensing means for turning the apparatus off at a predetermined cooling compartment temperature, as well as turning the apparatus off when the door to the cooling chamber is open in order to conserve energy. Other desirable convenience features, such as those useful in a household appliance, well known to those skilled in the art, also be incorporated.

A most important component of the apparatus of the present invention is the complex compound used to achieve the rapid cooling or quick-freeze feature. In prior U.S. Pat. No. 4,848,994, a number of suitable compounds are disclosed, the description of which is incorporated herein by reference. Specifically, the preferred compounds used in the appliance of the present invention comprise chlorides, bromides, sulphates or chlorates of a metal selected from the group consisting of an alkali and alkaline earth metal, chromium, manganese, iron, cobalt, nickel, cadmium, tantalum and rhenium. The most preferred salts for use in the present apparatus are calcium bromide, strontium bromide, strontium chloride, cobalt chloride, nickel chloride, and ferrous and ferric chloride, complexed with ammonia to form complexes disclosed in the aforesaid incorporated patent description. The other double chloride salts disclosed in the aforesaid patent may also be included herein, with specific salts being chosen primarily for efficiency in the cycling adsorption and desorption reactions. Calcium bromide complexed with 2 to 6 moles ammonia per mole of calcium bromide is especially preferred and provides evaporator temperatures between −70° F. and −30° F. during adsorption at heat rejection (complex compound) temperatures of between about 70° F. and about 125° F. with half-cycle times (i.e., adsorption or desorption) of about 20 minutes or less, highly advantageous and practical for cooling or freezing apparatus systems. Thus, a preferred apparatus of the invention incorporates a plurality of reactors containing the aforesaid ammonia/calcium bromide complex compound, in which a first reactor (or group of reactors) is heated for desorbing the ammonia while heat is removed from a second reactor (or group of reactors) to provide for adsorption of the ammonia.

In the apparatus of the invention, using the complex compounds of the invention in the reactors in the cyclic adsorption and desorption reactions, temperatures in the range of −10° F. to −70° F. in the evaporator are readily achieved within a relatively short period of time. Moreover, because of the nature of the complex compounds, and the efficient and yet simple design of the appliance of the present invention, the reactors in which the complex compounds are contained may be relatively small, and may be efficiently designed according to the technology described in U.S. patent application Ser. No. 07/320,562, filed Mar. 8, 1989, the description of which is incorporated herein by reference.

Another important aspect of the apparatus of the invention is the volume of the reaction chamber in the reactors and the amount of metal salt charged in the reactors, and that relationship with the relative size of the cooling chamber. By way of example, for a typical household appliance having a cooling chamber volume of, for example, between about 20 and about 40 liters, a preferred reaction chamber volume is between about 2.5 and 10 liters, with between about 500 and about 4,500 grams of metal salt charged to each reactor. Where such an appliance is designed with normal or state of the art insulation for the cooling chamber walls, and where that chamber is thermally isolated from the condenser and reactors compartments, such an apparatus will typically have a cooling power level of between about 50 and 1,500 watts. This translates into a time requirement for freezing most foods or compositions having an ambient temperature, or a temperature which is not unduly elevated, for example, below about 80° F., within about 20 minutes, or less, depending upon the consistency and density of the material to be frozen. Even for a relatively large volume of composition or dense material, for example, food such as meat and the like, time requirements for freezing will be substantially less than if the same material were to be frozen in a typical freezer compartment.

In operation of the apparatus, ammonia is evaporated in the evaporator 40 to provide low temperature air to the cooling chamber 20 as air is circulated from the cooling chamber across the evaporator heat exchange surfaces by fan 42. The operation is initiated by the user activating or turning on the appliance at controller 45, which will initiate one of two phases, depending on the extent of the phase completed during the previous operation. Typically the controller will cause the ammonia vapor in the evaporator to flow to the reactor which has been most desorbed (least adsorbed), and is capable of adsorbing the ammonia. By way of example, assuming the complex compound in reactor 22 to be least adsorbed, i.e., less rich in adsorbed ammonia as compared to reactor 24, if time phase "A" is selected at the controller, this initially causes valve 16 to open, fans 42 and 25 to operate and to energize resistance heater 23 in reactor 24. As valve 16 is opened, reactor 22 is cooled by ambient room temperature air drawn through vent 38 by fan 25, whereby the relatively cool reactor has a lower ammonia vapor pressure than the ammonia pressure in the evaporator. Thus, the ammonia vapor flows to reactor 22 via valve 16, conduit 44, one-way or check valve 29 and conduit 56. Ammonia adsorption in the complex compound of reactor 22 will continue until the complex is saturated, normally occurring in about five to about fifteen minutes. During adsorption, heat generated in the reactor is vented to atmosphere via vent 37.

Concurrently with ammonia adsorption in reactor 22, desorption of ammonia from the complex compound in reactor 24 occurs as heater 23 is energized and quickly raises the temperature of the complex compound until the ammonia vapor pressure exceeds ammonia vapor pressure at room temperature. Check valve 32 then opens and ammonia vapor flows from reactor 24 via conduit 53 into condenser 30. Heat of condensation is removed by room temperature air blown over the condenser by fan 31. Although when valve 16 is initially opened some ammonia vapor may flow into reactor 24, since this desorbing reactor is quickly heated, such ammonia flow will occur for only a short period of time until the ammonia pressure of the complex compound exceeds the vapor pressure of the evaporator, which will then cause check valve 28 to close. During operation, condensed ammonia is directed from high pressure condenser 30 to the relatively low pressure evaporator 40 via conduit 46 through expansion valve 14 or a capillary tube to continuously provide ammonia to the evaporator to provide cooling. Alternatively, the evaporator may be of the liquid overfeed or flooded type.

When ammonia desorption of the complex compound in desorbing reactor 24 is complete, which normally takes between about 5 and about 20 minutes, the controller will reverse the cycle and turn off heater 23 in reactor 24, energize heater 21 in reactor 22, de-energize fan 25, and energize fan 26. The subsequent cycle is substantially identical to the previously described cycle with only the reactors being reversed for adsorption and desorption, respectively. Of course, the running time selected at the controller may terminate operation before a cycle is complete, and the controller may function to carry out internal completion of the cycle where it would be beneficial. Start-up of a subsequent operation may be as previously described, or depending on the extent of cycle completion and the new timing selected, and the time elapsed since cycle termination, the controller may cause the subsequent operation to run without reversing the cycles, which may be especially advantageous where the new operation time selected is relatively short and can be completed before cycle reversal is necessary.

The controller 45 may include a microcomputer having control and timing means cooperating with switching means for actuating the appropriate fans and heaters during operation. The fans 31 and 42 will operate continuously to force air over the evaporator and condenser until the appliance is shut off. As an alternative for the various valves, including valve 16 and the one-way valves, a single four-way valve cooperating with suitable conduits may be used for achieving the same function of directing the ammonia between the components as previously described.

The apparatus may also include means for defrosting the cooling chamber, for example, a switching means for operating the fan 42 independently of the other appliance fans, heaters and valves of the apparatus. Although the preferred embodiment disclosed and illustrated herein is of household appliance size, the same technology may be scaled-up for larger refrigeration systems such as walk-in cold storage boxes, or scaled down for a specific laboratory use, for example, rapidly cooling or freezing test tubes, or for relatively small appliances such as cold fingers or ice-cube makers, and the like, utilizing the same components as previously described.

Figure 3:
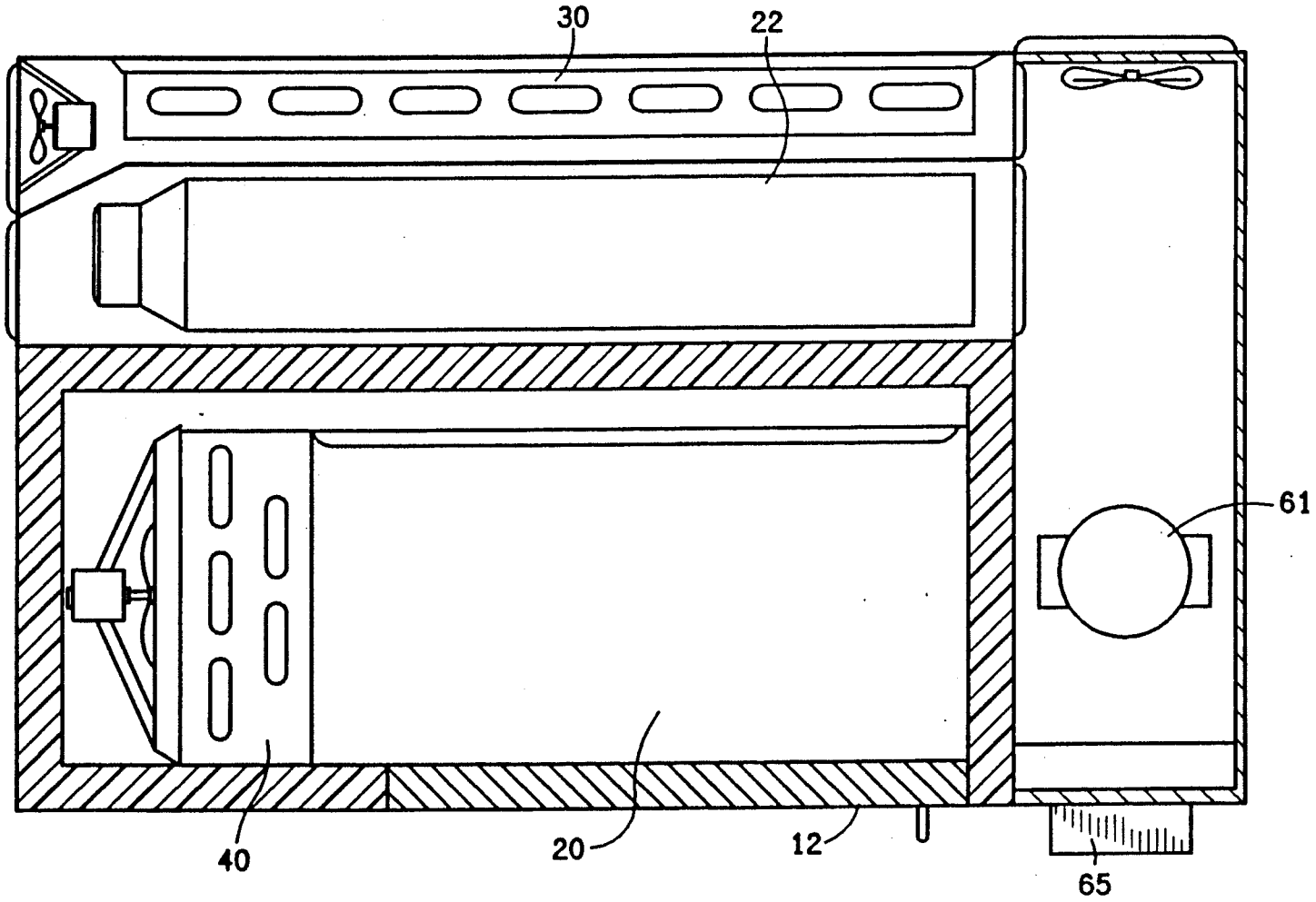
FIG. 3 is an open top view of an apparatus schematically illustrating another embodiment of the invention comprising an appliance combining rapid cooling and microwave heating features.

Another embodiment of the invention is illustrated schematically in FIG. 3 in which the apparatus of the invention is used in an appliance which combines the advantages of rapid cooling or freezing as previously described with a microwave oven. In the embodiment of such an appliance, a few of the components shown in FIGS. 1 and 2 are also observed in FIG. 3, including condenser 30, evaporator 40, reactor 22 and chamber 20. In such an appliance, the cooling chamber is also used for a microwave heating chamber. The apparatus illustrated includes a magnetron 61 or similar microwave tube for providing a microwave radiation source for microwave heating or cooking. Such a practical apparatus also conveniently includes a control panel 65, on which the switches for selecting the heating or cooling function timing and power level, etc., normally associated with a household microwave oven appliance are provided. Other components of such a microwave cooking apparatus known to those skilled in the art may also be included in such an apparatus, and are not further described herein.

Another use of the apparatus of the invention is with a conventional refrigerator thus providing a third cold temperature level with highly conventional cooling or freezing.

These, as well as other uses and advantages of the apparatus are intended to be within the purview of the invention disclosed herein.

What is claimed:

1. An apparatus capable of rapidly cooling or freezing a composition placed in a cooling chamber thereof comprising:

a walled housing member having a cooling chamber therein and a door thereon for accessing said cooling chamber from the exterior of said housing member, an evaporator containing ammonia, and air handling means for circulating cold air from said evaporator to said cooling chamber, a condenser for converting gaseous refrigerant to a liquid phase, and means for cooling said condenser with ambient air, first and second reactors, each containing a complex compound of ammonia and a chloride, bromide, sulphate or chlorate salt of a metal selected from the group consisting of an alkali and alkaline earth metal, chromium, manganese, iron, cobalt, nickel, cadmium, tantalum and rhenium, a first heater in said first reactor and a second heater in said second reactor, for heating the complex compound therein, respectively, first valve means cooperating with first conduit means for alternately directing ammonia from said evaporator to said first and second reactor, respectively, second valve means cooperating with second conduit means for alternately directing ammonia from said first and second reactors, respectively, to said condenser, third valve means cooperating with third conduit means for directing ammonia from said condenser to said evaporator, control means for sequentially operating said heaters for alternately heating said complex compounds in said first and second reactors, for operating said air handling means, and for operating said first valve means, and switching means for being connected to a source of electrical power for turning said apparatus on and for energizing said control means when said switching means is actuated.

2. Apparatus of claim 1 wherein said air handling means comprise a fan actuated by said control means.

3. Apparatus of claim 1 including first and second heat exchange means for alternatively cooling said first and second reactors, respectively.

4. Apparatus of claim 1 wherein said first conduit means includes one-way flow directing means for directing the flow of ammonia only from said evaporator to said reactors, and wherein said second valve means includes one-way flow directing means for directing the flow of ammonia only from said reactors to said condenser.

5. Apparatus of claim 3 wherein said first and second heat exchange means comprise fans, and said control evans includes means for energizing said fans.

6. Apparatus of claim 1 wherein said third valve means comprises an expansion valve or capillary tube.

7. Apparatus of claim 1 wherein said evaporator comprises a liquid overfeed or flooded evaporator.

8. Apparatus of claim 1 wherein said walled housing member includes interior walls for thermally isolating said evaporator and said cooling chamber from said condenser and said reactors.

9. Apparatus of claim 5 wherein said walled housing member includes a port adjacent said fans and communicating exteriorly of said housing member.

10. Apparatus of claim 1 wherein said complex compound comprises calcium bromide and between 2 and 6 moles ammonia per mole of calcium bromide operating to provide an evaporator temperature of between about −70° F. and about −30° F. during adsorption at complex compound heat rejection temperature of between about 70° F. and about 125° F.

11. The apparatus of claim 1 wherein said salt comprises calcium bromide.

12. The apparatus of claim 1 wherein said salt comprises calcium bromide, strontium chloride, cobalt chloride, cobalt chloride, nickel chloride, ferrous chloride or ferric chloride.

13. An apparatus of claim 1 including a microwave tube for providing radiation for selectively heating material in said chamber, and switching means for selectively providing cooling or heating to said cooling chamber.

14. The apparatus of claim 1 wherein said first and said second reactors comprise one or more reactors, respectively.

15. An apparatus comprising, in combination, an apparatus of claim 1 and a mechanical compressor driven refrigerator or freezer.

16. A household appliance capable of rapidly cooling or freezing a composition placed in a cooling chamber thereof comprising:

a walled housing member having a cooling chamber therein having a volume of between about 20 liters and about 40 liters and a door thereon for accessing said cooling chamber from the exterior of said housing member, an evaporator containing ammonia, and air handling means for circulating cold air from said evaporator to said cooling chamber, a condenser for converting gaseous refrigerant to a liquid phase, and means for cooling said condenser with ambient air, first and second reactors, each containing a complex compound of ammonia and a chloride, bromide, sulphate or chlorate salt of a metal selected from the group consisting of an alkali and alkaline earth metal, chromium, manganese, iron, cobalt, nickel, cadmium, tantalum and rhenium, a first heater in said first reactor and a second heater in said second reactor, for heating the complex compound therein, respectively, first valve means cooperating with first conduit means for alternately directing ammonia from said evaporator to said first and second reactor, respectively, second valve means cooperating with second conduit means for alternately directing ammonia from said first and second reactors, respectively, to said condenser, third valve means cooperating with third conduit means for directing ammonia from said condenser to said evaporator, control means for sequentially operating said heaters for alternately heating said complex compounds in said first and second reactors, for operating said air handling means, and for operating said first valve means, and switching means for being connected to a source of electrical power for turning said apparatus on and for energizing said control means when said switching means is actuated.

17. Appliance of claim 16 wherein said first and second reactors each comprise a cavity containing said complex compounds having a volume of between about 2.5 and about 10 liters.

18. Appliance of claim 17 wherein between about 500 and about 4,500 grams of metal salt is initially present in each of said reactors.

19. Appliance of claim 16 wherein said metal salt is selected from the group consisting of calcium bromide, strontium bromide, strontium chloride, cobalt chloride, nickel chloride, ferrous chloride and ferric chloride.

20. Appliance of claim 18 wherein said metal salt comprises calcium bromide.

21. Appliance of claim 16 wherein said first and second heaters comprise resistance heaters.

22. Appliance of claim 16 including means for defrosting said cooling chamber.

23. Appliance of claim 22 wherein said means for defrosting includes switching means for operating said air handling means without operating the resistance heaters for said reactors and said first valve means.

24. In combination, an appliance of claim 16 including a microwave tube for supplying microwave radiation for selectively heating a composition placed in said chamber, and switching means for selectively providing cooling or heating to said cooling chamber.

25. The apparatus of claim 16 wherein said first and said second reactors comprise one or more reactors, respectively.

26. An appliance capable of selectively cooling or heating a composition placed in a chamber thereof comprising:

a walled housing member having a cooling chamber therein and door thereon for accessing said cooling chamber from the exterior of said housing member, an evaporator containing ammonia, and air handling means for circulating cold air from said evaporator to said cooling chamber, a condenser for converting gaseous refrigerant to a liquid phase, and means for cooling said condenser with ambient air, first and second reactors, each containing a complex compound of calcium bromide and between 2 and 6 molecules of ammonia, a first heater in said first reactor and a second heater in said second reactor, for heating the complex compound therein, respectively, first valve means cooperating with first conduit means for alternately directing ammonia from said evaporator to said first and second reactor, respectively, second valve means cooperating with second conduit means for alternately directing ammonia from said first and second reactors, respectively, to said condenser, third valve means cooperating with third conduit means for directing ammonia from said condenser to said evaporator, control means for sequentially operating said heater for alternately heating said complex compounds in said first and second reactors, for operating said air handling means, and for operating said first valve means, a microwave tube for providing microwave radiation for selectively heating said chamber, and switching means for being connected to a source of electrical power for turning said appliance on and for selectively operating said apparatus to provide cooling and heating for a composition placed in said chamber.

27. The apparatus of claim 26 wherein said first and said second reactors comprise one or more reactors, respectively.

28. An apparatus comprising, in combination, an appliance of claim 26 and a mechanical compressor driven refrigerator or freezer.

* * * * *